United States Patent [19]

Gross et al.

[11] Patent Number: 4,537,744

[45] Date of Patent: Aug. 27, 1985

[54] HIGH-TEMPERATURE PROTECTION LAYER

[75] Inventors: Franz Gross, Neckargemünd; Georg Wahl, Eppelheim; Andrew R. Nicoll, Oftersheim, all of Fed. Rep. of Germany

[73] Assignee: BBC Aktiengesellschaft Brown, Boveri & Cie, Baden, Switzerland

[21] Appl. No.: 556,639

[22] Filed: Nov. 30, 1983

[30] Foreign Application Priority Data

Dec. 16, 1982 [DE] Fed. Rep. of Germany ..... 3246507

[51] Int. Cl.[3] ..... C22C 19/05

[52] U.S. Cl. ..... 420/446; 420/445; 428/678; 428/679

[58] Field of Search ..... 420/446, 445; 428/678, 428/679

[56] References Cited

U.S. PATENT DOCUMENTS

| | | | |
|---|---|---|---|
| 3,754,902 | 8/1973 | Boone et al. | 420/446 |
| 4,248,629 | 2/1981 | Pons et al. | 420/446 |

FOREIGN PATENT DOCUMENTS

| | | | |
|---|---|---|---|
| 667101 | 7/1963 | Canada | 420/446 |
| 0088599 | 9/1983 | European Pat. Off. | 420/445 |
| 3213868 | 10/1983 | Fed. Rep. of Germany | 420/46 |
| 583845 | 1/1947 | United Kingdom | 420/446 |

OTHER PUBLICATIONS

Rolf Nordheim et al, J. of Metals, pp. 211–218, Feb. 1954.

A. Taylor, J. of Metals, pp. 1356–1362, Oct. 1956.

*Primary Examiner*—Veronica O'Keefe

*Attorney, Agent, or Firm*—Herbert L. Lerner; Laurence A. Greenberg

[57] ABSTRACT

High-temperature protection layer of an alloy with a base of aluminum, chromium and nickel, particularly for structural gas-turbine elements of an austenitic material. The base material of the alloy contains at least 8 to 12 atom % aluminum and 28 to 28 atom % chromium with the remainder nickel, and at least silicon and titanium are admixed to the base material as additives such that at a temperature below 900° C., a passive cover layer of chromium oxide, and at a temperature above 900° C., a passive cover layer of aluminum oxide is developed on the applied alloy.

4 Claims, No Drawings

HIGH-TEMPERATURE PROTECTION LAYER

BACKGROUND OF THE INVENTION

1. Field of the Invention

The invention relates to a high-temperature protection layer of an alloy with a base of aluminum, chromium and nickel, adapted particularly for protecting structural gas-turbine elements of an austenitic material.

2. Description of the Prior Art

Such high-temperature protection layers find application particularly in protecting the base material of structural elements of heat resistant steels and/or alloys which are used at temperatures above 600° C. These high-temperature protection layers are to retard the effect of high-temperature corrosion particularly of sulfur, oil ashes, oxygen, earth alkalies and vanadium. The high-temperature protection layers are applied directly to the base material of the structural element. High-temperature protection layers are of particular importance in structural elements of gas turbines. They are applied particularly to rotor and guide vanes as well as to segments of gas turbines subject to localized heat. In manufacturing these structural elements, an austenitic material based on nickel, cobalt or iron is preferably used. In the manufacture of gas-turbine parts, nickel superalloys particularly are used as the base material. The high-temperature protection layers to be applied consist preferably of chromium-containing alloys. It has been customary heretofore to use two high-temperature protection layers, of which one of them is suitable for parts which are subjected to temperatures below or around 900° C. Under operating conditions, where the high-temperature protection layer is stressed thermally, this protection layer develops at its surface a passive cover layer of chromium oxide.

A second high-temperature protection layer is known which is preferably applied to parts which are subjected to the effects of temperature substantially above 900° C. This high-temperature protection layer has the property, when under operating conditions under which it is stressed thermally, of developing a passive cover layer of aluminum oxide on its surface.

A disadvantage of each of these high-temperature protection layers is that each is suitable only for a very definite temperature range. For structural parts which are subjected to changing temperature influences, especially to those in which the temperature range varies between values below 900° C. and far above 900° C., optimum protection is not possible since neither of the two mentioned protection layers is suitable for both operating conditions.

SUMMARY OF THE INVENTION

It is, therefore, an object of the invention to provide a protection layer, on the surface of which a passive cover layer is formed, that can successfully protect structural parts subjected to temperatures below 900° C. as well as far above 900° C.

With the foregoing and other objects in view, there is provided in accordance with the invention a high-temperature protection layer, adapted particularly for protecting structural gas-turbine elements of austenitic material subjected to temperatures below and above 900° C., of an alloy with a base material containing at least 8 to 12 atom % aluminum, 18 to 28 atom % chromium, with the remainder nickel, and at least silicon and titanium admixed to the base material as additives to induce a passive cover layer of chromium oxide to develop on the alloy at a temperature below 900° C., and a passive cover layer of aluminum oxide to develop on the alloy at a temperature above 900° C.

Other features which are considered as characteristic for the invention are set forth in the appended claims.

Although the invention is illustrated and described herein as embodied in a high-temperature protection layer, it is nevertheless not intended to be limited to the details shown, since various modifications may be made therein without departing from the spirit of the invention and within the scope and range of equivalents of the claims.

The invention, however, together with additional objects and advantages thereof will be best understood from the following description.

DETAILED DESCRIPTION OF THE INVENTION

The invention relates to a high-temperature protection layer consisting of an alloy with a base of aluminum, chromium and nickel. The base material of the alloy contains 8 to 12 atom % aluminum and 18 to 28 atom % chromium with the remainder nickel. According to the invention, silicon and titanium are admixed as additives to the base material such that a passive cover layer of aluminum oxide or chromium oxide, respectively, develops at the surface of the high-temperature protection layer as a function of the respective thermal stress to which the alloy is subjected.

If the high-temperature protection layer according to the invention is applied to a structural element, at least one passive cover layer develops on its surface as soon as the structural element is subjected to thermal stress. This passive cover layer protects the high-temperature protection layer against rapid wear. On the surface of the high-temperature protection layer, two different passive cover layers can develop. In particular, the development of the passive cover layer of chromium oxide and a passive cover layer of aluminum oxide is possible. Which of the two passive cover layers is developed on the surface of the high-temperature protection layer depends on the operating conditions and particularly on the temperature range in which the structural element operates.

If the operating temperature of the structural element is below or around 900° C., a passive cover layer of chromium oxide develops on the high-temperature protection layer. The base material, of which the alloy of the high-temperature protection layer is made, also contains chromium and aluminum, in addition to nickel. Additions of titanium and silicon to the base material induce the chromium to diffuse to the surface of the layer under operating conditions under which the high-temperature protection layer is thermally stressed. There, under the action of the oxygen-containing atmosphere, the chromium forms the desired passive chromium oxide cover layer which effects the corrosion protection proper.

If now the same structural element is subjected to the action of a temperature which is above 900° C., the passive cover layer of chromium oxide is formed. Under the influence of the additives, consisting of silicon and titanium as well as of the higher temperature, the aluminum present in the base material of the alloy begins to diffuse to the surface of the high-temperature protection layer. There, it reacts with the oxygen-containing atmosphere of the environment to form a passive aluminium oxide cover layer. This passive cover layer is resistant to high-temperature corrosion. No removal of this aluminum oxide passive cover layer at temperatures above 900° C. was found. It protects the high-temperature protection layer proper against rapid water and can thereby contribute permanently to the protection of the structural element proper. The same properties are exhibited also by the passive cover layer of chromium oxide which is formed at low temperatures.

If the structural element again comes into the action range of a lower temperature, this passive cover layer of aluminum oxide reverts and a passive chromium cover layer is again formed on the surface of the high-temperature protection layer.

According to the invention, the base material of the alloy includes at least 8 to 12 atom % aluminum and 18 to 28 atom % chromium. A preferred composition of the alloy contains 9 atom % aluminum and 18 atom % chromium. The remainder of the alloy in both cases is nickel. According to the invention, silicon and titanium are admixed to the base material as additives. In particular, the base material of the above-mentioned alloy contains 1 to 6 atom % silicon and 1 to 3 atom % titanium based in the base material of the alloy. The base material of the alloy in powder form is applied to the austenitic structural elements to be covered by means of the plasma spraying process in the low-pressure range.

The invention will be explained in greater detail by reference to an embodiment example which describes the manufacture of a coated structural gas-turbine element. The structural element itself is made of an austenitic material with a base of nickel, cobalt or iron. Preferably, a nickel superalloy, particularly IN 738 is used. The structural element is coated by means of the plasma spraying process in the low pressure range. The base material of the alloy which forms the high-temperature protection layer consists of a powder which has 18 atom % chromium and 9 atom % aluminum, with the remainder of the base material consisting of nickel. In addition,, the base material contains 1 to 6 atom % silicon and 1 to 3 atom % titanium based on the base material of the alloy. The alloy present in powder form has preferably a grain size of 45 μm. The structural element to be coated is first cleaned chemically and then roughened by means of a sand blaster. The structural element is coated under vacuum by means of the plasma spraying process. The parts of the structural element which are not to be coated are covered before the coating. The structural element is heated to about 800° C. by means of the plasma jet before the high-temperature protection layer is applied. The alloy which forms the high-temperature protection layer is applied directly to the base material of the structural element. Argon and hydrogen are used as a plasma stream. The plasma stream current is 580 amperes and the voltage applied is 80 volts. After the alloy is applied to the structural element, the latter is subjected to a heat treatment. This takes place in a high-vacuum annealing furnace. There, a pressure p is maintained which is lower than $5\times10^{-3}$ torr. After the vacuum is reached, the furnace is heated to a temperature of 1100° C. This temperature is maintained for about one hour with a tolerance of about ±4° C. Subsequently, the heating of the furnace is terminated. The coated, heat-treated structural element is slowly cooled down in the furnace.

We claim:

1. High-temperature protection layer for protecting structural elements of austenitic material subjected to temperatures below and above 900° C., of an alloy applied to the austenitic structural material, said alloy having a base material containing at least 8 to 12 atom % aluminum, 18 to 28 atom % chromium, with the remainder nickel and 1 to 6 atom % silicon and 1 to 3 atom % titanium based on the base material of the alloy admixed to the base material as additives to induce a passive cover layer of chromium oxide to develop on the alloy at a temperature below 900° C., and a passive cover layer of aluminum oxide to develop on the alloy at a temperature above 900° C.

2. High-temperature protection layer according to claim 1, wherein the base material of the alloy contains 9 atom % aluminum and 18 atom % chromium with the remainder nickel.

3. High-temperature protection layer according to claim 1, wherein the alloy is applied to the austenitic structural elements by plasma spraying in the low pressure range.

4. High-temperature protection layer according to claim 2, wherein the alloy is applied to the austenitic structural elements by plasma spraying in the low pressure range.

* * * * *